US005465591A

United States Patent [19]

Cur et al.

[11] Patent Number: 5,465,591

[45] Date of Patent: Nov. 14, 1995

[54] DUAL EVAPORATOR REFRIGERATOR WITH NON-SIMULTANEOUS EVAPORATOR

[75] Inventors: Nihat O. Cur, Royalton Township, Berrien County; Steven J. Kuehl, Lincoln Township, Berrien County; Jatin C. Khanpara; Douglas D. LeClear, both of St. Joseph Township, Berrien County; James R. Peterson, Lincoln Township, Berrien County, all of Mich.

[73] Assignee: Whirlpool Corporation, Benton Harbor, Mich.

[21] Appl. No.: 80,279

[22] Filed: Jun. 21, 1993

Related U.S. Application Data

[63] Continuation-in-part of Ser. No. 930,968, Aug. 14, 1992, abandoned.

[51] Int. Cl.[6] ..... F25D 11/04; F25B 5/00

[52] U.S. Cl. ..... 62/439; 62/199; 62/525

[58] Field of Search ..... 62/199, 200, 117, 62/525

[56] References Cited

U.S. PATENT DOCUMENTS

| | | | |
|---|---|---|---|
| 2,182,318 | 12/1939 | Newill | 62/200 |
| 2,237,261 | 4/1941 | McGrath | 62/200 X |
| 2,323,354 | 7/1943 | Rees | 62/438 X |
| 2,576,663 | 11/1951 | Atchison | 62/199 |
| 2,604,761 | 7/1952 | Atchison | 62/525 X |
| 2,865,181 | 12/1958 | Anderson et al. | 62/199 |
| 2,939,473 | 6/1960 | McDougall | 62/199 X |
| 3,108,455 | 10/1963 | Tinkey | 62/200 |
| 3,390,540 | 7/1968 | Brush | 62/200 |
| 3,786,648 | 1/1974 | Rice | 62/200 |
| 4,242,116 | 12/1980 | Aschberger et al. | 62/199 |
| 4,439,998 | 4/1984 | Horvay et al. | 62/199 |
| 4,873,837 | 10/1989 | Murray | 62/199 |
| 4,891,952 | 1/1990 | Yoshikawa et al. | 62/199 |
| 4,916,916 | 4/1990 | Fischer | 62/199 |
| 5,031,413 | 7/1991 | Tsuihiji et al. | 62/234 |
| 5,033,272 | 7/1991 | Yoshikawa et al. | 62/199 |
| 5,156,016 | 10/1992 | Day | 62/199 |

*Primary Examiner*—William E. Wayner

*Attorney, Agent, or Firm*—Stephen D. Krefman; Joel M. Van Winkle; Robert O. Rice

[57] ABSTRACT

A refrigeration appliance having at least two refrigeration compartments, each compartment having its own access door, is provided wherein there is a first evaporator for the first compartment, the first evaporator operating at a first pressure level and a second evaporator for the second compartment, the second evaporator operating at a pressure level higher than the first pressure level. There is a single condenser, a single compressor, a refrigerant circuit having a series of conduits with different flow control capabilities for providing a flow of refrigerant sequentially, that is, not simultaneously, to the first and second evaporators, the condenser and compressor, and various valves in the refrigerant circuit for directing refrigerant to a selected one of the evaporators from the condenser and for preventing a flow of refrigerant into the first evaporator when refrigerant is being directed into the second evaporator to cool the second compartment.

20 Claims, 6 Drawing Sheets

DUAL EVAPORATOR REFRIGERATOR WITH NON-SIMULTANEOUS EVAPORATOR

This is a continuation-in-part of application Ser. No. 07/930,968, filed Aug. 14, 1992.

BACKGROUND OF THE INVENTION

The present invention relates to refrigeration appliances and more particularly to refrigeration appliances having dual evaporators.

In typical domestic refrigeration appliances, the appliance oftentimes has two separate compartments which are maintained at different temperatures. For example, there may be a freezer compartment which has a temperature maintained below 0° C. and a fresh food compartment which is maintained at a temperature somewhat above 0° C.

In many commercially available refrigeration devices a single evaporator is used with an evaporating pressure of approximately 0–2 psig. Air is circulated over the evaporator from both the freezer compartment and the refrigerator compartment. This "mixed" air flow scheme results in dehumidification of the refrigerator compartment and subsequent frost build-up of the single evaporator coil, necessitating a periodic defrost cycle to get rid of the accumulated frost.

Also, using a single evaporator to provide the cooling for two compartments which are maintained at different temperatures results in an inefficient use of the refrigerator system for the higher temperature compartment.

It is known in the art to utilize multiple evaporators in refrigeration appliances. U.S. Pat. No. 2,576,663 discloses the use of two evaporators, each for its own refrigeration compartment. The evaporators are alternately supplied with refrigerant through a control valve.

U.S. Pat. No. 3,390,540 discloses the use of multiple evaporators in a refrigeration system. Each evaporator is controlled by an expansion valve and it is possible to operate more than one evaporator at a time.

U.S. Pat. No. 3,108,453 discloses a multiple evaporator refrigeration system in which the evaporators may be used independently of each other. Also a phase change material is used in connection with at least one of the evaporators.

U.S. Pat. No. 3,786,648 discloses the use of multiple evaporators for controlling the temperature in multiple compartments with the evaporators operating independently of each other.

U.S. Pat. No. 4,439,998 discloses a refrigeration apparatus having multiple evaporators with an electronically controlled valve system to deliver refrigerant to one evaporator in preference to the other, but causing the valve system to deliver refrigerant to the other evaporator after a predetermined amount of time.

U.S. Pat. No. 4,916,916 discloses the use of a phase change energy storage material in connection with a multiple evaporator refrigeration system.

SUMMARY OF THE INVENTION

The present invention provides a refrigeration appliance with multiple evaporators in which the evaporator circuits operate sequentially, that is, not simultaneously. In the preferred embodiments disclosed there are two evaporator circuits, one operating a freezer compartment and the other operating a fresh food compartment. The freezer compartment runs typically at 0–2 psig evaporation pressure until satisfied. The refrigerator section then runs typically at 18–22 psig evaporation pressure, at which pressure level, significant energy reductions are achieved.

A single compressor supplies the refrigerant through the condenser which serves to feed either the high or low pressure evaporators through known expansion devices such as capillary tubes, orifices, expansion valves, etc. Although various circuit options are disclosed, each employ some type of solenoid valve at the capillary tube inlet to determine which evaporator is fed. The expansion or flow control device feeding the high pressure evaporator, which cools the fresh food compartment, has to be less restrictive than the flow control device feeding the low pressure freezer evaporator, to accommodate the higher refrigerant flow rates going through the high pressure evaporator circuit. If capillary tubes are used as the flow control devices, then the capillary tube feeding the high pressure evaporator would be larger in diameter and/or shorter in length than the capillary tube feeding the low pressure, freezer evaporator.

In some embodiments of the invention a phase change material may be utilized with one or more of the evaporators in order to utilize a more efficient compressor and to reduce the overall energy consumption by the refrigeration appliance.

DETAILED DESCRIPTION OF THE PREFERRED EMBODIMENTS

Figure 1:
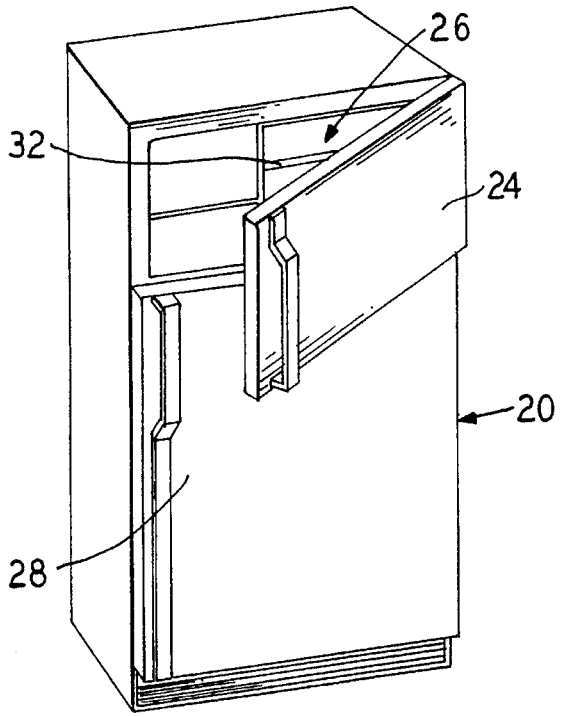
FIG. 1 is a perspective view of a refrigeration appliance embodying the principles of the present invention.
Figure 2:
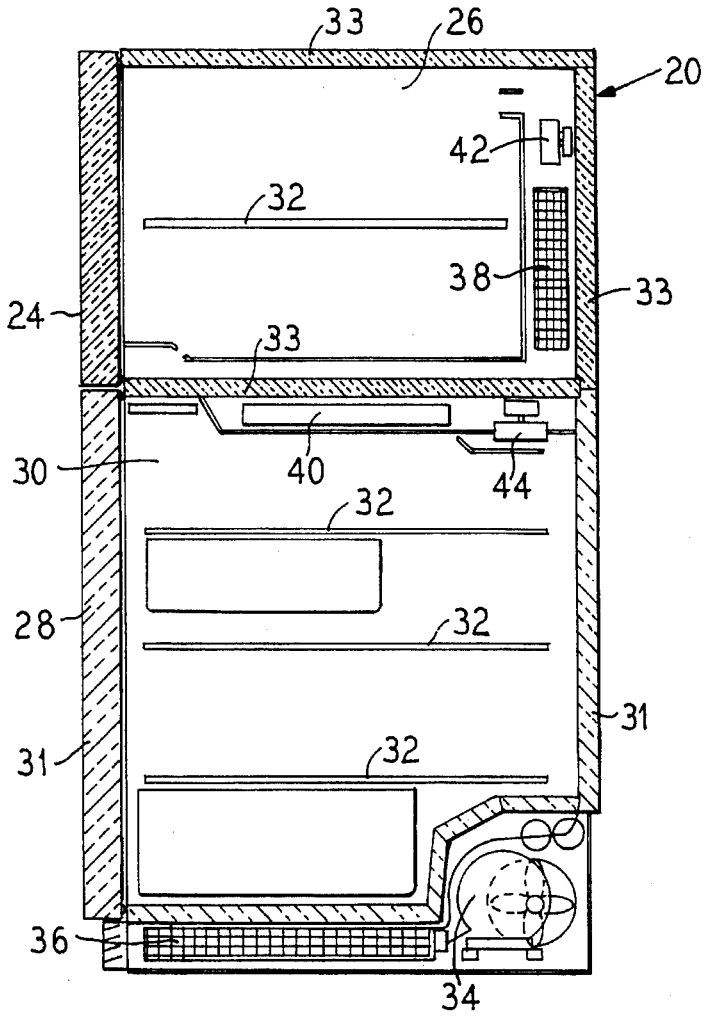
FIG. 2 is a side sectional view of the appliance of FIG. 1.

In FIGS. 1 and 2 there is shown generally a refrigeration appliance at 20 which comprises an exterior cabinet 22 having a first openable door 24 to expose a first interior compartment 26 and a second openable door 28 to expose a second interior compartment 30. Within each of the compartments 26, 30 there may be one or more shelves 32 for receiving food articles. Generally one of the compartments 26, 30 will be maintained at a temperature sufficiently below 0° C. to assure that all of the articles contained within that compartment will be maintained in a frozen state. The other compartment generally is maintained somewhat above 0° C. to maintain the items placed therein in a chilled, but not frozen condition.

In order to maintain the compartments at the desired temperature levels a refrigeration device is provided which comprises a compressor 34, a condenser 36, an evaporator 38 for the first compartment 26 and a second evaporator 40 for the second compartment 30. Appropriate air moving devices 42, 44 are provided as deemed necessary for circulating air within each of the compartments past its respective evaporator to maintain a fairly consistent temperature throughout each compartment. In some configurations natural convection could be used to provide circulating air for the evaporator in lieu of the air moving devices. The actual refrigeration circuits are illustrated in greater detail in FIGS. 3 and 6 through 11.

Figure 3:
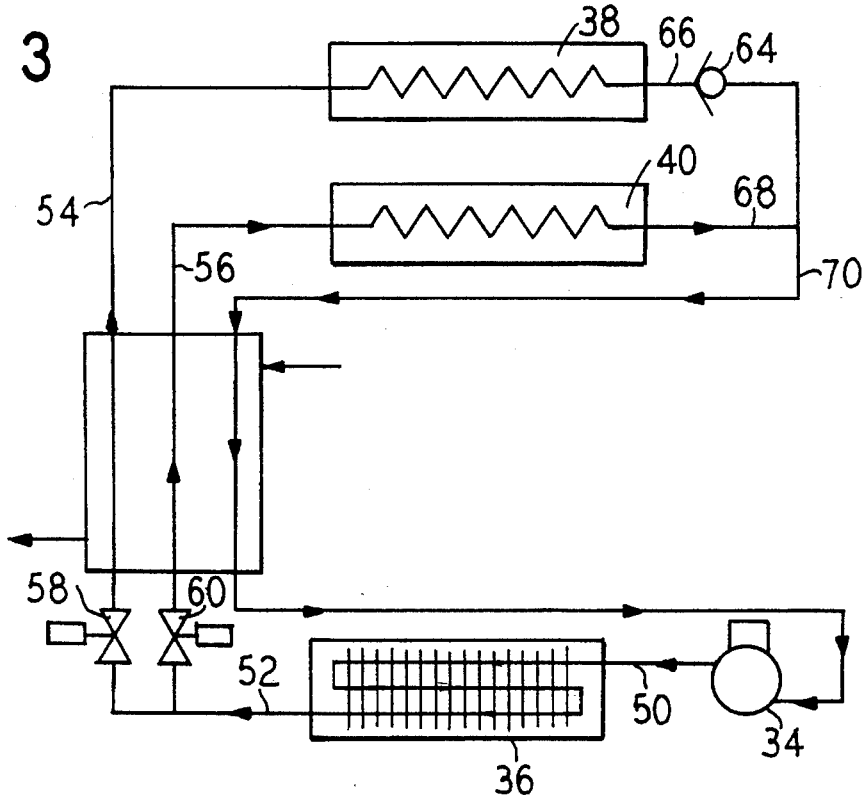
FIG. 3 is a first embodiment of a refrigeration circuit diagram.
Figure 6:
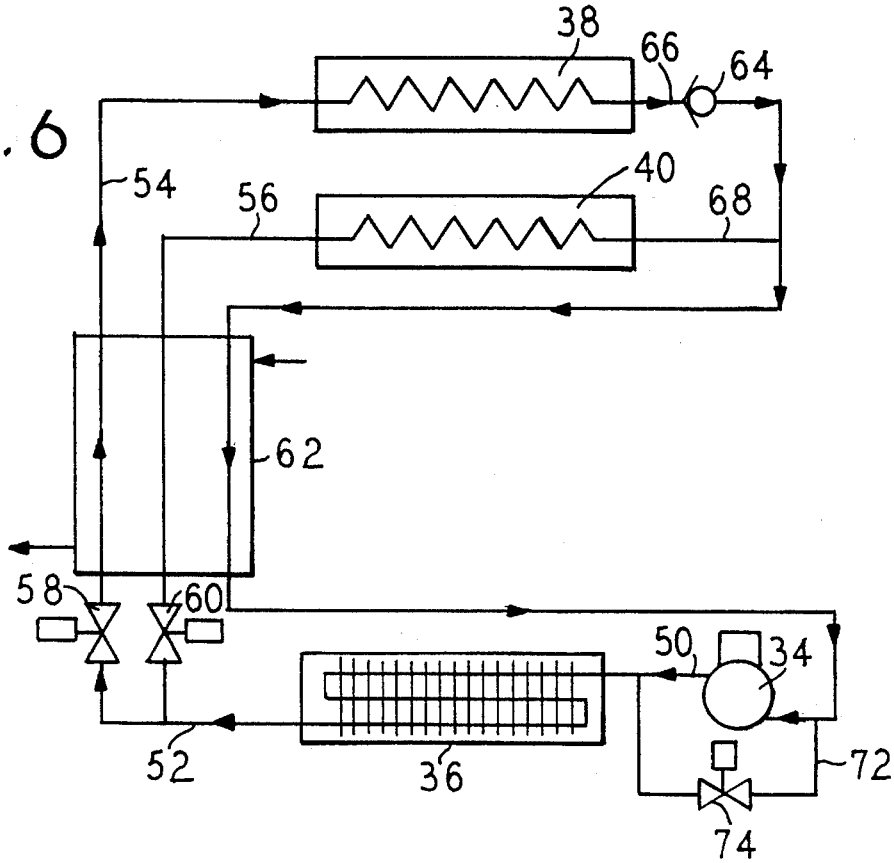
FIG. 6 is a second embodiment of a refrigeration circuit diagram.

In FIG. 3 a first embodiment of a refrigeration circuit is illustrated. In this embodiment the single compressor 34 supplies refrigerant through line 50 to the single condenser 36. Refrigerant then flows out of condenser on line 52 and is presented to capillary tubes (or other flow control devices) 54, 56 each of which are supplied with an individual latching type solenoid valve 58, 60. The solenoid valves 58 and 60 should preferably be the latching type which requires power for a brief moment (a fraction of a second) to change position from open to closed or vice versa. If the latching type valves are not used, then the valve 58 should be a normally closed type and the valve 60 should also preferably be a normally closed type but the normally open type can be used too. Capillaries 54 and 56 pass through a heat exchanger 62 towards evaporators 38 and 40 respectively. In order to handle higher refrigerant flow rates due to larger suction pressures, the capillary tube 56 feeding the high pressure evaporator 40 (fresh food compartment evaporator) is less restrictive (larger diameter and/or shorter length) than the capillary tube 54 which feeds the low pressure, freezer evaporator 38. A check valve 64 is provided on suction line 66 which exits from evaporator 38. Suction line 68 which exits from evaporator 40 has no such valve. Lines 66 and 68 join in a return suction line 70 which also passes through the heat exchanger 62 on its return to the compressor 34.

Figure 4:
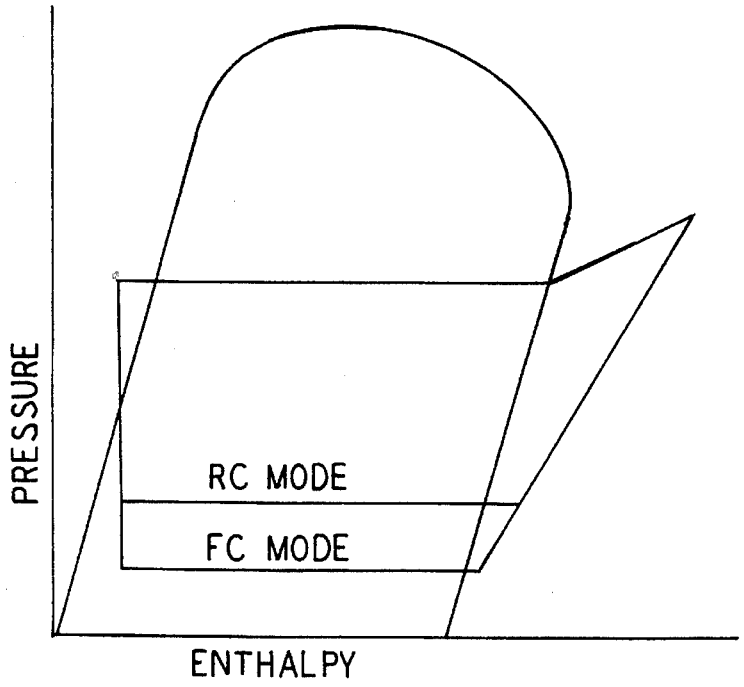
FIG. 4 is the representation of the refrigeration cycle on a pressure-enthalpy diagram.

FIG. 4 is the representation of the sequentially-operated two evaporator refrigeration system on a pressure-enthalpy diagram. As shown in FIG. 4, FC mode indicates the freezer mode of operation and the evaporation occurs at a lower suction pressure similar to the conventional refrigeration system. RC mode indicates the fresh food compartment cooling and the evaporation occurs at a higher suction pressure.

Figure 5:
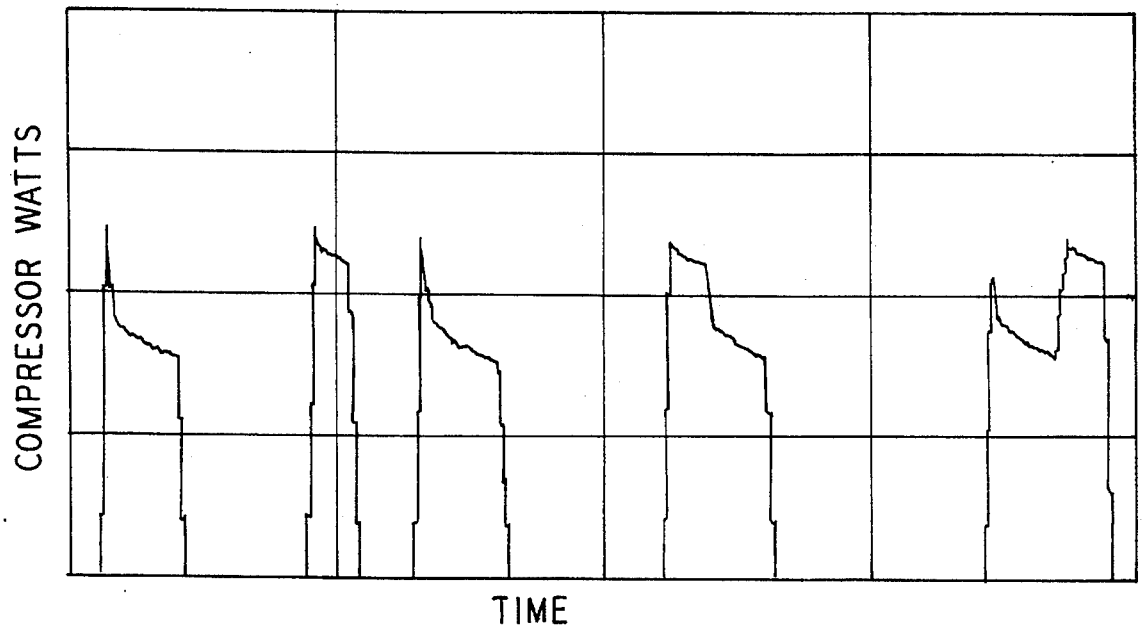
FIG. 5 is a typical representation of the compressor power usage against time with a sequentially-operated dual evaporator refrigerator.
Figure 7:
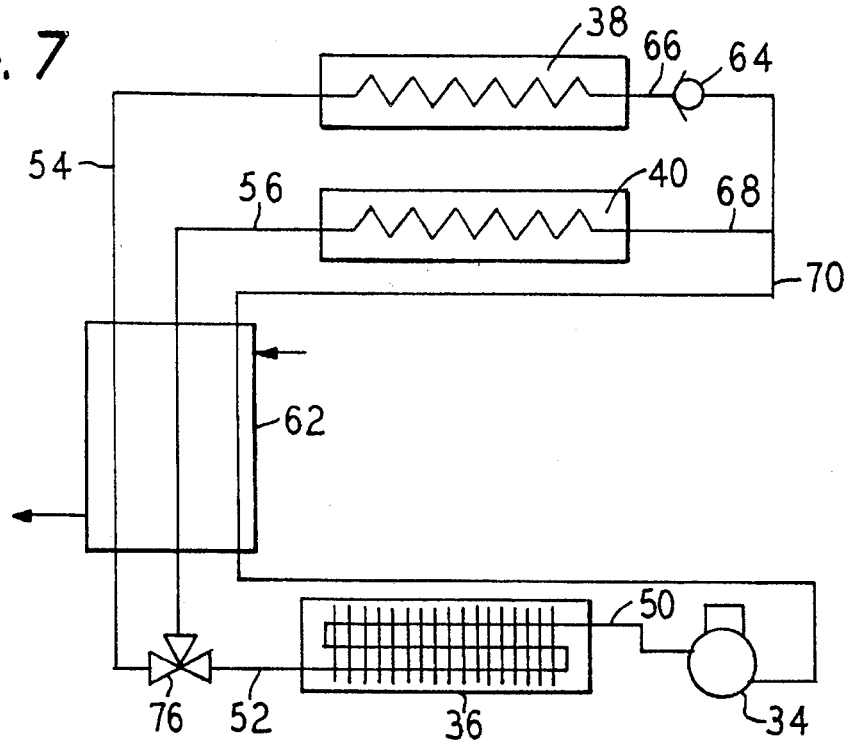
FIG. 7 is a third embodiment of a refrigeration circuit diagram.

FIG. 5 is the typical compressor power data (y-axis) vs time (x-axis) graph. As shown in FIG. 5, the fresh food cooling mode has the higher compressor power peaks and the freezer compressor operation has the lower compressor power peaks and no power consumption (off-cycle) in between the on-cycle modes of operation. As is apparent from the actual power data, at times the fresh food cooling mode and the freezer cooling mode follow each other in a sequential manner with no off-cycle in between and at other times they are separated with an off-cycle in between.

A second embodiment (FIG. 6) of the refrigeration cycle contains many of the same components which are identified with the same reference numerals as used in FIG. 3. The primary difference between the embodiment of FIG. 6 and that of FIG. 3 is that a bypass line 72 is provided around the compressor 34 which allows pressure equalization across the compressor through a solenoid valve 74 prior to its start-up.

Again, a third embodiment (FIG. 7) of the refrigeration cycle contains many of the same components which are identified with the same reference numerals as used in FIG. 3. The primary difference between the embodiment of FIG. 7 and that of FIG. 3 is that a three-position latching valve 76 is utilized at the junction of lines 52 and 56 which allows refrigerant to flow either through line 56 or line 54, but not both. The third position of the valve 76 is to close both lines 56 and 54.

Applicants have determined that it presently appears that the embodiment illustrated in FIG. 3 has the highest potential for energy reduction during operation. Therefore, the various modes of operation of the two evaporators will be described with respect to that embodiment.

In this embodiment evaporator 38 is utilized in the refrigerator compartment 26 which is maintained at a below freezing temperature and thus the evaporator is operated at a lower pressure, generally in the range of 0–2 psig.

Evaporator 40 is utilized in the fresh food compartment and is normally maintained above freezing temperature and is operated at a higher pressure, generally in the range of 18–22 psig. With sufficient thermal insulation provided around the freezer compartment 26, the percentage run time in the freezer mode, that is, the mode in which refrigerant is supplied to evaporator 38, can be reduced significantly, such as to approximately 20–25% of the overall run time. The remaining run time is utilized in operating evaporator 40 for the fresh food compartment.

Since the evaporator 40 operates at a higher suction pressure, where the compressor 34 has a much higher cooling capacity, a lower capacity down-sized compressor could be used in such a system. Some slight to moderate downsizing of the compressor is possible and utilized with the invention. The compressor may be downsized 0 to 40% in cooling capacity with respect to a state of the art single evaporator, single compressor system embodied in a similar refrigerator cabinet. However, current compressor technology results in a degradation of efficiency of the compressor in smaller, lower capacity sizes when the compressor is downsized too far. This degradation is due to the mechanical and manufacturing limitations of smaller compressor mechanisms.

Therefore, Applicants have found that the compressor 34 similar in capacity to that of a comparable conventional single evaporator vapor compression system or somewhat down-sized in capacity (but still too large for the sequentially-operated dual evaporator system) can be used in disclosed embodiments with the excess cooling capacity being stored as thermal energy in a thermal storage or phase change material associated with evaporator 40 (and evaporator 38 if desired) such that the material will change phase either from a gas to a liquid or from a liquid to a solid during operation of evaporator 40. An example of this type of material could be a mixture of water (80 to 100%) and an organic material, such as propylene glycol (20 to 0%). This permits the compressor to be run less frequently, and excess compressor cooling capacity to be absorbed thus allowing it to run at higher suction pressures as desired, and relying on the phase change material to absorb heat energy during periods when the refrigerant is not being supplied through evaporator 40. Of course, the excess cooling capacity can also be handled by making the evaporator 40 larger with adequate fresh food compartment evaporator airflow, but the evaporator 40 would occupy more space thus taking more volume from the refrigerated space.

In order to provide a switch in between two distinct refrigeration circuits for sequential, that is, non-simultaneous operation and to maintain proper charge distribution in the circuit, the current invention utilizes refrigerant valves 58 and 60 and a check valve 64. The refrigeration valves 58 and 60 can be of the kind which are operated by a solenoid but are not limited to that. In fact, the preferred embodiment illustrated in FIG. 3 utilizes two latching type solenoid valves for valves 58 and 60. The regular solenoid valves require electrical power (5 to 15 watts range) to their coils to remain open or closed (depends on whether they are normally closed or open type), therefore necessitating power consumption at least for a certain portion of their operation. Also, some of the power used by the valve coil gets transferred to the refrigerant in the form of heat. Both of these affect the overall refrigeration system energy efficiency to a small degree and reduce the energy savings expected from a sequentially-operated dual evaporator system. The latching solenoid valves (valves 58 and 60 in FIG. 3), on the other hand, require only a pulse (very brief, in terms of milliseconds) of electrical input to change position but requiring no other power input to remain open or closed.

The check valve 64 is unique to this invention and is vital for the proper refrigerant charge distribution during the sequential operation. Without it, the higher pressure refrigerant from evaporator 40 during the fresh food cooling mode would go to the lower pressure area in the colder freezer evaporator 38 and accumulate there. Since the refrigerant charge is determined based on only a single circuit, the refrigerant accumulation in evaporator 38 would cause the system to have less than the optimum refrigerant charge, thus starving the evaporator 40 during the fresh food cooling mode. The check valve 64 with the higher suction pressure on line 70 closes during the fresh food cooling mode, therefore preventing the refrigerant from accumulating in the evaporator 38. During the freezer cooling mode, the suction pressure on line 70 goes down and the check valve 64 opens up, thus allowing flow through the evaporator 38. Since the suction pressure on line 70 is lower than the pressure in the evaporator 40 during the freezer cooling mode, there is no need for such a check valve on the fresh food evaporator 40 outlet.

With respect to the modes of operation of the refrigeration circuit of FIG. 3, FIGS. 8–11 illustrate the various operation modes.

Figure 8:
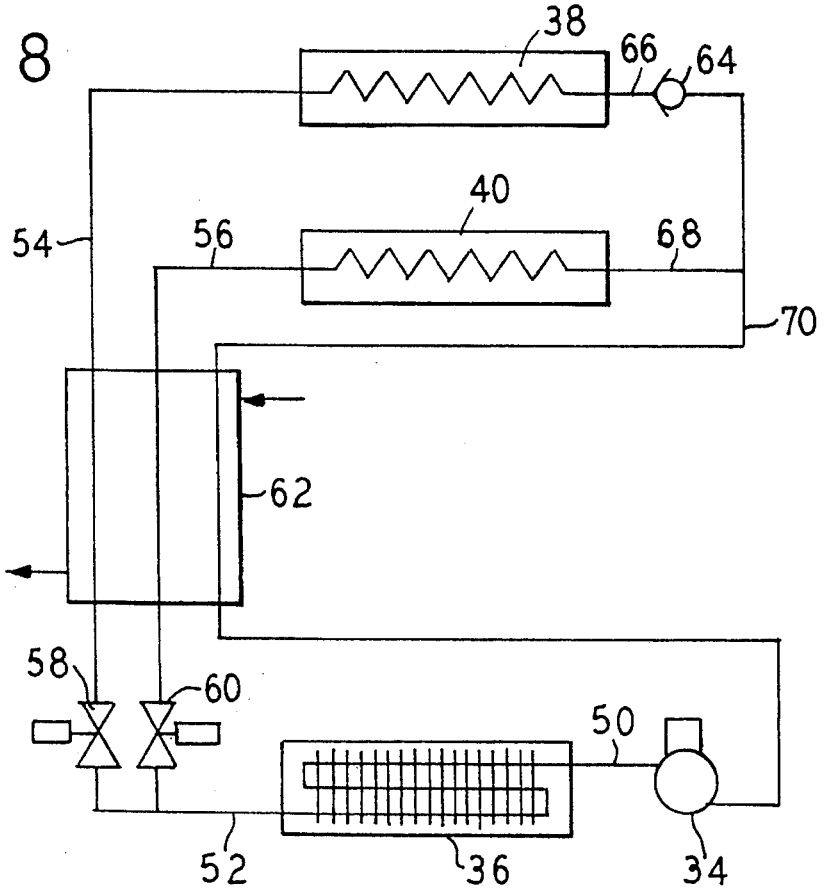
FIG. 8 is the first embodiment of the refrigeration circuit diagram shown in an off-cycle mode.

In FIG. 8 the off-cycle mode is illustrated. In that mode of operation, latching solenoid valve 60, joining lines 56 and 52, and latching solenoid valve 58, joining lines 54 and 52, are both closed for the major portion of the off-cycle. Check valve 64 on line 66 is also closed during the off-cycle mode and there is basically no refrigerant (some refrigerant vapor might be present) in lines 54, 56, 66 and 68 or in evaporators 38 and 40. The refrigerant therefore is present throughout a circuit which includes the compressor 34, line 50, condenser 36 and line 52. At the end of an off-cycle (when either compartment calls for cooling), the latching solenoid valve 60 is energized briefly to open, thus permitting refrigerant migration and pressure equalization through the fresh food circuit while the compressor 34 is still in an off condition (typically a 3 minute equalization time is required).

Figure 9:
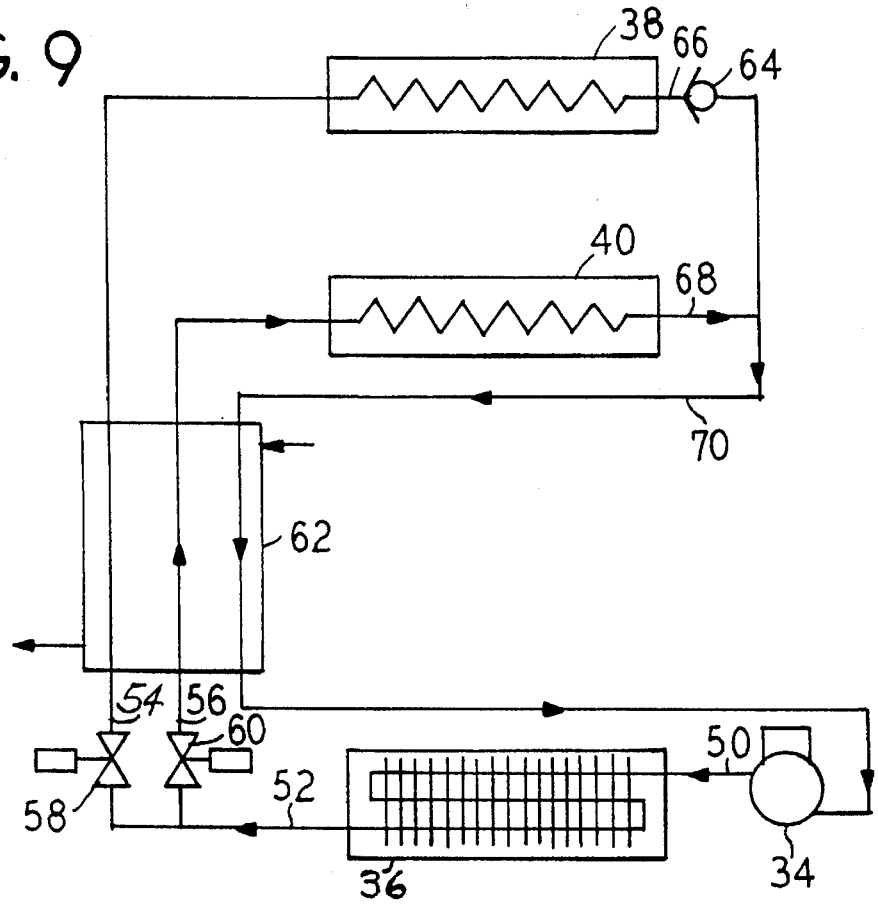
FIG. 9 is the first embodiment of the refrigeration circuit diagram shown in a fresh food cooling mode.

FIG. 9 illustrates operation of the system in a fresh food cooling mode. The pressure equalization (not needed if this cycle comes just after the freezer mode of operation) and the subsequent fresh food cooling mode are initiated and the fresh food cooling mode is terminated in response to an appropriate control signal representing a temperature condition of the fresh food compartment 30, time dependent signal or other control. In this mode, the latching solenoid valve 60 is now open (just after the pressure equalization) and remains non-energized and thus in the same condition as described at the end of an off-cycle. If this mode follows the freezer cooling mode, then the latching solenoid valve 58 is briefly energized to close and the latching solenoid valve 60 is briefly energized to open. Also, check valve 64 is normally closed and the latching solenoid valve 58 is closed (same as in the off-cycle mode shown in FIG. 8).

The major difference in FIG. 9 is that the compressor 34 is on and thus refrigerant is being pumped through the circuit in the direction of the arrows. Thus, refrigerant flowing from the condenser 36 flows through line 52 and capillary 56, (less restrictive than capillary 54) through the heat exchanger 62 and into evaporator 40 where heat is absorbed from the air circulating over the evaporator 40 in refrigerator compartment 30 as well as absorbed from the phase change material (if used) associated with evaporator 40. The refrigerant then flows through suction lines 68 and 70, back through the heat exchanger 62 to return to the compressor 34.

Figure 10:
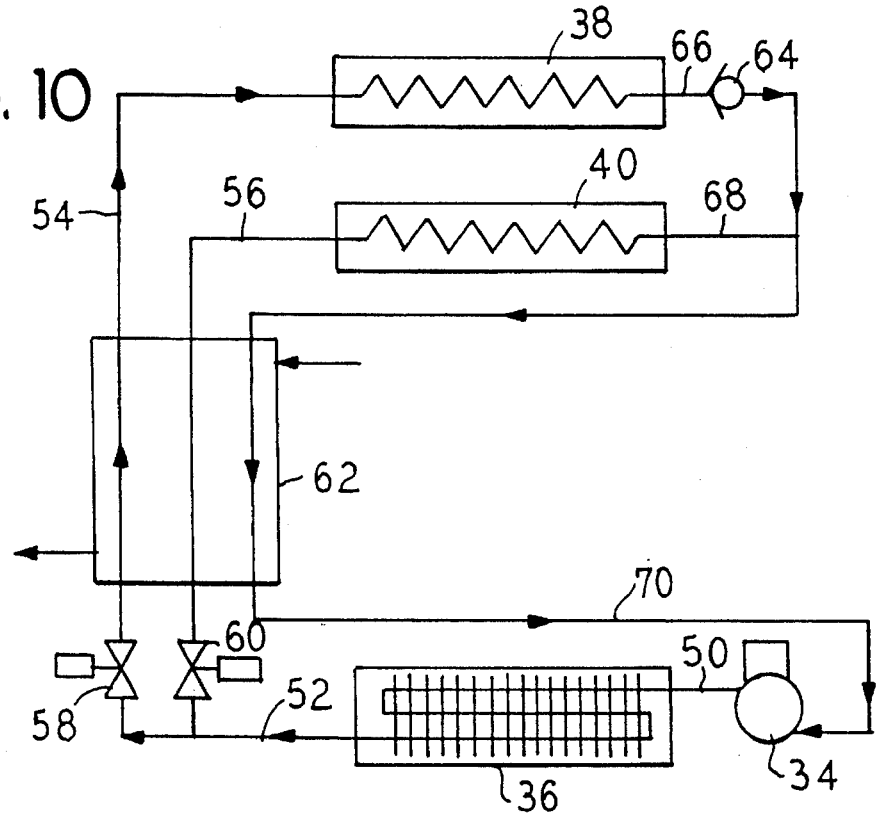
FIG. 10 is the first embodiment of the refrigeration circuit diagram shown in a freezer cooling mode.

FIG. 10 illustrates the operation of the circuit with the evaporator 38 in operation, that is, the freezer cooling mode. This mode is also initiated and terminated in response to an appropriate control signal representing a temperature condition of the freezer compartment 26, a time dependent signal or other control signal. If freezer cooling mode is initiated after an off-cycle, the latching solenoid valve 60 is open during the pressure equalization period to allow pressure equalization over the fresh food compartment cooling circuit. Once the pressure equalization is complete or if the freezer cooling mode starts after a fresh food cooling cycle, the latching solenoid valve 60 is briefly energized to close and the latching solenoid valve 58 is briefly energized to open (to start the freezer cooling) so that line 52 is opened to capillary 54 and closed to capillary 56. Check valve 64 will be open due to a flow of refrigerant into it from evaporator 38.

In this mode of operation, the compressor is required to provide a much lower pressure on suction line 70. In this mode refrigerant is supplied from the compressor 34 through line 50, condenser 36, line 52, and line 54 to the evaporator 38 and then out line 66 through valve 64 to line 70 to return to the compressor. Any refrigerant remaining in line 56 and evaporator 40 will be at a higher pressure and thus there will not be any migration of refrigerant from line 66 into line 68 and evaporator 40. With valve 60 closing the connection between line 52 and line 56, line 68 will represents a high pressure dead end line, thus blocking any flow of refrigerant into line 68 from line 66.

Figure 11:
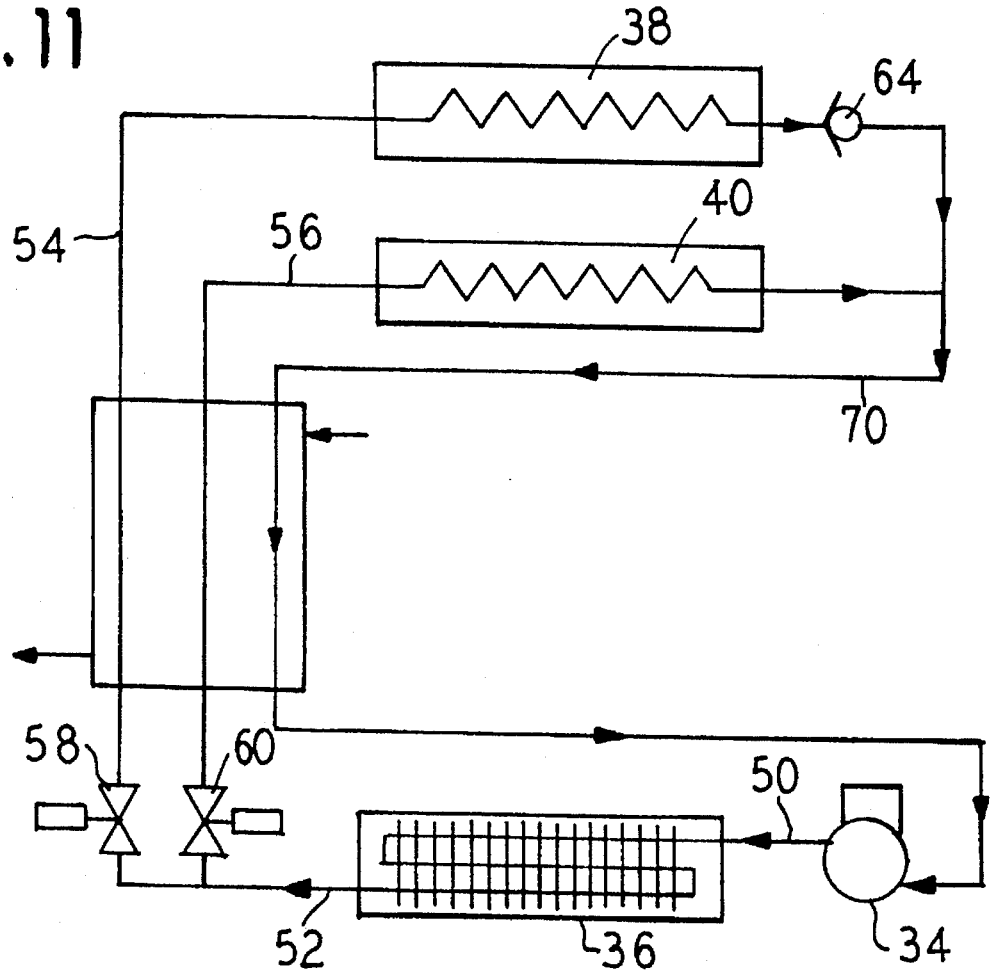
FIG. 11 is the first embodiment of the refrigeration circuit diagram shown in a freezer evaporator pump-out mode.

FIG. 11 discloses a pump-out mode during which time refrigerant is pumped out of the evaporator 38 at the end of the freezer cooling mode. In this mode of operation the latching solenoid valve 60 remains closed thus keeping a closed path between line 52 and capillary 56 leading to high pressure evaporator 40. The latching solenoid valve 58, however, is also briefly energized or electrically pulsed and thus moved to a closed position thus preventing flow of refrigerant from line 52 to capillary 54. Check valve 64 is opened due to the low pressure in line 70.

In this mode of operation the compressor 34 runs to provide the low pressure suction on line 70. This low pressure suction causes refrigerant to be evacuated both from evaporator 38 and evaporator 40. This step is undertaken to assure that sufficient refrigerant will be available for efficient operation of evaporator 40 in the mode shown in FIG. 9. Since the refrigeration circuit only has sufficient refrigerant for the evaporator 38 circuit or the evaporator 40 circuit alone, the refrigerant charge distribution is critical and it is absolutely necessary that the refrigerant does not get trapped in evaporator 38 during the fresh food mode operation, thus requiring the pump-out mode illustrated in FIG. 11 at the end of the freezer cooling mode illustrated in FIG. 10.

Following completion of the pump out mode of FIG. 11, which can occur for a predetermined time period or in response to a sensed condition, the compressor 34 is first turned off, the valves 58 and 60 remain closed if an off-cycle mode of operation is to follow. With the compressor 34 turned off and the valves 58 and 60 closed, check valve 64 will close due to low pressure in evaporator 38 and relatively higher pressure in line 70, thus resulting in the condition shown in FIG. 8 as the off-cycle mode. At the end of the off-cycle mode, refrigerant will be allowed to migrate through line 56 and evaporator 40 to equalize pressure across the compressor thereby permitting an easier start condition for the compressor. If a fresh food mode operation is to follow the pump-out mode, then the compressor 34 will remain on, the valve 58 will close and the valve 60 will open at the end of the pump-out mode.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A refrigeration appliance having at least two refrigeration compartments, each compartment having its own access door, comprising:

a first evaporator for said first compartment, said first evaporator operating at a first pressure level;

a second evaporator for said second compartment, said second evaporator operating at a pressure level higher than said first pressure level;

a single condenser;

a single compressor;

a refrigerant circuit comprising a series of conduits for providing a flow of refrigerant in a non-simultaneous manner to said first and second evaporators, said condenser and compressor;

valve means in said refrigerant circuit for directing refrigerant to a selected one of said evaporators from said condenser and for preventing a flow of refrigerant into said first evaporator when refrigerant is being directed into said second evaporator to cool said second compartment; and means in said refrigerant circuit for evacuating refrigerant from said first evaporator after termination of flow of refrigerant to said first evaporator.

2. A refrigeration appliance according to claim 1, wherein said first evaporator and said second evaporator are coupled independently of each other with a thermal storage material.

3. A refrigeration appliance according to claim 1, wherein said means for evacuating comprises at least one valve in said circuit operable to prevent flow of refrigerant into said evaporators while said compressor is still running.

4. A refrigeration appliance according to claim 1, wherein said first compartment is maintained at a temperature below 0° centigrade.

5. A refrigeration appliance according to claim 1, wherein said second compartment is maintained at a temperature above 0° centigrade.

6. A refrigeration appliance according to claim 1, wherein said refrigeration circuit comprises a conduit leading from said condenser to said first evaporator with a valve positioned in said conduit, a second conduit leading from said condenser to said second evaporator with a second valve positioned in said second conduit, and a third conduit leading from said first evaporator to said compressor with a third valve positioned in said third conduit.

7. A refrigeration appliance according to claim 6, wherein said first and second valves are two way valves and said third valve is a check valve.

8. A refrigeration appliance according to claim 1, wherein said refrigeration circuit comprises a conduit leading from said condenser to said first evaporator with a valve positioned in said conduit, a second conduit leading from said condenser to said second evaporator, and a third conduit leading from said first evaporator with a second valve positioned in said third conduit.

9. A refrigeration appliance according to claim 1, wherein said second evaporator is directly coupled with a thermal storage material for storing excess capacity of said second evaporator.

10. A refrigeration appliance according to claim 1, wherein said first evaporator is coupled with a thermal storage material.

11. A refrigeration appliance having at least two refrigeration compartments, each compartment having its own access door, comprising:

a first evaporator for said first compartment, said first evaporator operating at a first pressure level;

a second evaporator for said second compartment, said second evaporator operating at a pressure level higher than said first pressure level;

a single condenser;

a single compressor;

a refrigerant circuit comprising a series of conduits for providing a flow of refrigerant in a non-simultaneous manner to said first and second evaporators, said condenser and compressor;

said refrigeration circuit comprising a conduit leading from said condenser to said first evaporator with a valve positioned in said conduit, a second conduit leading from said condenser to said second evaporator with a second valve positioned in said second conduit, and a third conduit leading from said first evaporator to said compressor with a third valve positioned in said third conduit; and valve means in said refrigerant circuit for directing refrigerant to a selected one of said evaporators from said condenser and for preventing a flow of refrigerant into said first evaporator when refrigerant is being directed into said second evaporator to cool said second compartment said first valve and said second valve being the latching-type On/OFF valves.

12. A refrigeration appliance having at least two refrigeration compartments, each compartment having its own access door, comprising:

a first evaporator for said first compartment, said first evaporator operating at a first pressure level;

a second evaporator for said second compartment, said second evaporator operating at a pressure level higher than said first pressure level;

a single condenser;

a single compressor;

a refrigerant circuit comprising a series of conduits for providing a flow of refrigerant in a non-simultaneous manner to said first and second evaporators, said condenser and compressor;

said refrigeration circuit comprising a conduit leading from said condenser to said first evaporator with a valve positioned in said conduit, a second conduit leading from said condenser to said second evaporator with a second valve positioned in said second conduit, and a third conduit leading from said first evaporator to said compressor with a third valve positioned in said third conduit; and valve means in said refrigerant circuit for directing refrigerant to a selected one of said evaporators from said condenser and for preventing a flow of refrigerant into said first evaporator when refrigerant is being directed into said second evaporator to cool said second compartment said first valve being a normally closed two way valve, said second valve being a two-way valve also normally closed between said condenser and said second conduit.

13. A refrigeration appliance having at least two refrigeration compartments, each compartment having its own access door, comprising:

a first evaporator for said first compartment, said first evaporator operating at a first pressure level;

a second evaporator for said second compartment, said second evaporator operating at a pressure level higher than said first pressure level;

a single condenser;

a single compressor;

a refrigerant circuit comprising a series of conduits for providing a flow of refrigerant in a non-simultaneous manner to said first and second evaporators, said condenser and compressor;

said refrigeration circuit comprising a conduit leading from said condenser to said first evaporator and to said second evaporator with a three-way valve positioned in between said conduit and said evaporators, and a second conduit leading from said first evaporator to said compressor with a second valve positioned on said second conduit; and valve means in said refrigerant circuit for directing refrigerant to a selected one of said evaporators from said condenser and for preventing a flow of refrigerant into said first evaporator when refrigerant is being directed into said second evaporator to cool said second compartment.

14. A refrigeration appliance according to claim 13, wherein said first valve is a three-position three-way valve, selectively providing a flow path leading from said condenser to said first evaporator, from said condenser to said second evaporator or completely closing said conduit from said condenser respectively, and said second valve is a check valve.

15. A refrigeration appliance according to claim 13, wherein said first valve is a three-position latching three-way valve.

16. A refrigeration appliance having at least two refrigeration compartments, each compartment having its own access door, comprising:

a first evaporator for said first compartment, said first evaporator operating at a first pressure level;

a second evaporator for said second compartment, said second evaporator operating at a pressure level higher than said first pressure level;

a single condenser;

a single compressor;

a refrigerant circuit comprising a series of conduits for providing a flow of refrigerant in a non-simultaneous manner to said first and second evaporators, said condenser and compressor; and valve means in said refrigerant circuit for directing refrigerant to a selected one of said evaporators from said condenser and for preventing a flow of refrigerant into said first evaporator when refrigerant is being directed into said second evaporator to cool said second compartment said second evaporator being directly coupled with a thermal storage material wherein said thermal storage material is a mixture of water and an organic substance.

17. A refrigeration appliance according to claim 16, wherein said thermal storage material is a mixture of water in the range of 80% to 100% and propylene glycol in the range of 20% to 0%.

18. A refrigeration appliance according to claim 16, wherein said thermal storage material is a mixture of 90% water and 10% propylene glycol.

19. A refrigeration appliance having at least two refrigeration compartments, each compartment having its own access door, comprising:

a first evaporator for said first compartment, said first evaporator operating at a first pressure level to maintain said first compartment at a temperature below 0° centigrade;

a second evaporator for said second compartment, said second evaporator operating at a pressure level higher than said first pressure level to maintain said second compartment at a temperature above 0° centigrade;

a single condenser;

a single compressor;

a refrigerant circuit comprising a series of conduits for providing a flow of refrigerant in a non-simultaneous manner to said first and second evaporators, said condenser and compressor; and valve means in said refrigerant circuit for directing refrigerant to a selected one of said evaporators from said condenser and for preventing a flow of refrigerant into said first evaporator when refrigerant is being directed into said second evaporator to cool said second compartment; and means in said refrigerant circuit for evacuating refrigerant from said first evaporator after termination of flow of refrigerant to said first evaporator.

20. A refrigeration appliance according to claim 19, wherein said refrigeration circuit comprises a conduit leading from said condenser to said first evaporator with a valve positioned in said conduit, a second conduit leading from said condenser to said second evaporator with a second valve positioned in said second conduit, and a third conduit leading from said first evaporator to said compressor with a third valve positioned in said third conduit.

* * * * *